United States Patent [19]

Morse

[11] 4,263,160

[45] Apr. 21, 1981

[54] PROCESS FOR THE PREPARATION OF STABLE DISPERSIONS OF ALKYL PHOSPHATE ESTERS

[75] Inventor: Suzanne A. Morse, Brandenburg, Ky.

[73] Assignee: Olin Corporation, New Haven, Conn.

[21] Appl. No.: 34,304

[22] Filed: Apr. 30, 1979

[51] Int. Cl.[3] ..... C11D 1/72; C11D 7/36

[52] U.S. Cl. ..... 252/174.16; 252/99; 252/135; 252/174.21; 252/174.22; 252/321; 252/DIG. 1; 252/DIG. 14

[58] Field of Search ..... 252/174.16, 174.21, 252/DIG. 17, 321, 358

[56] References Cited

U.S. PATENT DOCUMENTS

| | | | |
|---|---|---|---|
| 3,312,624 | 4/1967 | Dupre et al. | 252/135 |
| 3,314,891 | 4/1967 | Schmolka et al. | 252/174.16 X |
| 3,741,912 | 6/1973 | Kaneko | 252/529 |
| 3,935,121 | 1/1976 | Lieberman et al. | 252/321 |
| 4,018,696 | 4/1977 | Hellsten et al. | 252/135 X |
| 4,070,298 | 1/1978 | Scardera et al. | 252/99 X |

FOREIGN PATENT DOCUMENTS

| | | |
|---|---|---|
| 650839 | 1/1965 | Belgium . |
| 2812170 | 10/1978 | Fed. Rep. of Germany . |

*Primary Examiner*—P. E. Willis, Jr.
*Attorney, Agent, or Firm*—William D. Sabo

[57] ABSTRACT

A method for preparing storage stable dispersion of an alkyl phosphate ester dispersed in an alcohol which can be used as a component of detergent, which comprises heating the dispersion to a temperature sufficient to form a molten blend by liquifying the ester, rapidly cooling the molten blend to a temperature below the melting point of the ester, and vigorously agitating the dispersion during the cooling step.

15 Claims, No Drawings

PROCESS FOR THE PREPARATION OF STABLE DISPERSIONS OF ALKYL PHOSPHATE ESTERS

This process relates to an improved method of preparing certain dispersion compositions characterized by an enhanced stability against phase separation. More particularly, this invention relates to stable dispersions of deforming detergent compositions especially suited for use in automatic dishwashing machines. Specifically, this invention relates to defoaming phosphate ester—low-foaming nonionic surfactant combinations which are characterized by enhanced long term stability against phase separation.

In the past, such phosphate ester compositions in dispersion form have shown a tendency to "break"—that is some or all of the components separate out and/or the dispersion separates into phases during storage or exposure to low or elevated temperatures. The result of this separation is that the dispersion components are no longer uniformly distributed. The consequences of this non-uniform distribution can be serious as, for example, in commercial large scale operations where large quantities of the dispersion composition must be stored for long periods of time prior to use.

It is known in the prior art to employ, as automatic dishwashing detergent, alkaline detergent salts and mixtures of alkaline condensed phosphates, such as an alkaline detergent salt which may contain chlorinated trisodium phosphate. It is also known that such compositions can optionally be formulated with suitable surface active agents as described in U.S. Pat. No. 2,895,916, issued to Joseph A. Milenkevich and James E. Henjum on July 21, 1959. Aqueous solutions of the aforementioned compositions have good detergency, readily remove objectionable stains from plastic and ceramic dinnerware, and are easily rinsed from glasses, dishes and silverware without leaving undesirable film, streaks or spots thereon.

U.S. Pat. No. 3,314,891, issued to Irving R. Schmolka and Mason H. Earing on Apr. 18, 1967, discloses an automatic dishwashing detergent containing alkaline detergent salts. This detergent is formulated with a composition containing a nonionic surface active agent and at least one alkyl phosphate ester having 18 carbon atoms in the alkyl radical or, more specifically, selected from the group consisting of stearyl acid phosphate and oleyl acid phosphate.

As discussed in U.S. Pat. No. 3,741,912, issued to Thomas M. Kaneko on June 26, 1973, although the aforementioned alkyl phosphate ester, as described in U.S. Pat. No. 3,314,891, supra, having about 18 carbon atoms in the alkyl radical is effective, the alkyl phosphate ester does present a problem due to the insolubility and lack of dispersability in the nonionic surface active agent and results in segregation during storage, thus, causing problems in subsequent handling and formulating.

U.S. Pat. No. 3,741,912, supra, discloses the addition of an oxyethylated amine to the nonionic surfactant phosphate ester described above in an attempt to prevent the two components described above from separating during storage which causes problems in subsequent handling and formulating.

U.S. Pat. No. 4,070,298, issued to Michael Scardera and Robert N. Scott on Jan. 24, 1978, discloses and claims a storage stable dispersion composition for a conventional automatic dishwashing detergent comprised of (a) a select class of nonionic surfactants and (b) alkyl phosphate esters having an average of about 16 to about 28 carbon atoms in the alkyl radical.

However, in spite of the aforementioned patents and others, a need still exists in this particular art for a process for the preparation of a combination of nonionic surfactants and alkyl phosphate esters which can be employed in a commercial scale to prepare effective dishwashing detergent additives that have low-foaming and defoaming properties, will not separate from each other during long term storage, can be formulated with several combinations of inorganic detergent salts (referred to sometimes as "detergent builders") and do not need oxyethylated amines or other chemicals to prevent separation.

OBJECT

It is a primary object of this invention to provide a process for the preparation of a long term storage stable dispersion.

BRIEF DESCRIPTION OF THE INVENTION

A method of preparing a storage stable dispersion of an alkyl phosphate ester having an average of about 16 to about 28 carbon atoms in the alkyl radical dispersed in a nonionic surface active agent which comprises heating the dispersion to a temperature sufficient to form a molten blend by liquifying the ester, rapidly cooling the molten blend to a temperature below the melting point of the ester, and vigorously agitating the dispersion during the cooling step.

DETAILED DESCRIPTION OF THE INVENTION

The process of this invention employs rapid cooling and vigorous agitation of molten blends of alkyl phosphate esters and a nonionic surface active agent or surfactant to unexpectedly enhance the dispersion stability of the resulting dispersion.

Dispersions which may be employed in the process of this invention to produce a storage stable detergent additive composition in dispersion form are typically comprised of a blend of at least two selected additive components, one of which is an alkyl phosphate ester.

The typical alkyl phosphate ester has an alkyl group containing in the range from about 16 to about 28 carbon atoms and is blended with a nonionic surface active agent or surfactant.

Typical nonionic surface active agent components are generally the polyoxyalkylene adducts of hydrophobic bases wherein the oxygen/carbon ratio in the oxyalkylene portion of the molecule is greater than about 0.40.

A typical nonionic surfactant component is generally made by the sequential, i.e. block oxyalkylation of linear alcohols with (1) propylene oxide, (2) ethylene oxide followed by propylene oxide employing conventional techniques of preparing these types of adducts.

Preferred surfactant components are those generally made by the sequential, i.e. block oxyalkylation of alcohols with (1) 3 moles of propylene oxide (PO), (2) 12 moles of ethylene oxide (EO), followed by either 18 or 15 moles of propylene oxide (PO) employing conventional techniques of preparing these types of adducts.

As described in U.S. Pat. No. 3,314,891, supra, and U.S. Pat. No. 4,070,298, supra, the blending of the components of a dispersion in the predetermined proportions can readily be done in conventional mixing apparatus such as stirred reactor. The blend temperature is selected so that all components are in the liquid phase and are generally in the range from about 40° to about 100° C., and preferably in the range from about 70° to about 95° C., depending upon the melting point of the components employed. Previous to this, the blending step when desirable was followed by a grinding or flaking step so as to obtain the blended ingredients in a suitable particle size.

Although storage stability is noted in U.S. Pat. No. 4,070,298, supra, and U.S. Pat. No. 3,314,891, supra, it has now been found that long term stability is markedly increased for commercial scale production of the previously described dispersions when the molten blend of alkyl phosphate ester and nonionic surface active agent or surfactant as previously described is rapidly cooled to a temperature in the range from about 0 to about 50 and preferably in the range from about 20° to about 40° C., while vigorously agitated after blending at the selected blend temperature. For example, the period of storage stability is increased from about one month to about at least one year employing the process of this invention.

Without being bound by theory, it is believed that rapid cooling and vigorous agitation of the blend causes the phosphate esters to solidify into waxy slivers whose size decreases with more rapid cooling and vigorous agitation.

Throughout the description and claims, the term "rapidly cooling" is defined to mean cooling of the molten blend from the blend temperature at a rate about linear with time and greater than about 8° C. per hour.

Throughout the description and claims, the term "vigorous agitation" is defined to mean a physical state of the blend wherein various portions of the blend are in a highly turbulent and violent flux.

It is recognized that vacuum stripping of the molten blend may be employed along with rapid cooling and vigorous agitation. After the cooling step is completed, the vacuum stripping is terminated.

An agitation system such as a mechanical agitator having agitator blades mechanically moved through the molten blend may be employed to produce the desired vigorous agitation. The tip speed of the agitator blades is in the range from about 400 feet to about 900 feet per minute and preferably in the range from about 600 to about 800 feed per minute.

After rapid cooling and vigorous agitation, the dispersion may be added to the automatic dishwasher detergent formulation in order to reduce foaming during use thereof. Also, the ingredients of the dispersions of the invention can be added separately, in the proportions set forth, to selected automatic dishwasher detergents to accomplish defoaming.

The storage stability of several known dispersions are markedly increased by the process of this invention. For example, a first dispersion which can be adapted into conventional automatic dishwasher detergents is comprised of two components: a component A:

A nonionic surface active agent having the formula $$RO-(CH_2-\underset{\underset{R'}{|}}{CH}-O)_x-(CH_2-CH_2-O)_y-(CH_2-\underset{\underset{R''}{|}}{CH}-O)_z-H$$

wherein

R is a substantially linear, alkyl radical having an average in the range from about 6 to about 12 carbon atoms, preferably in the range from about 7 to about 10 carbon atoms, R′ is a linear, alkyl radical having an average in the range from 1 to about 4 carbon atoms, preferably from 1 to about 2 carbon atoms, and, is most desirably a methyl group, R″ is a linear, alkyl radical having an average in the range from 1 to about 4 carbon atoms, preferably from 1 to about 2 carbon atoms and most desirably a methyl group, x is an integer in the range from 1 to about 6, and preferably about 2 to about 4, y is an integer in the range from about 4 to about 20, and preferably about 5 to about 15, and z is an integer in the range from about 4 to about 25, and preferably about 6 to about 20;

and a component B:

an alkyl phosphate ester having an average of 16 to 28 carbon atoms in the alkyl radical; and wherein the weight ratio of (A):(B) is in the range from about 1:1 to about 99:1.

The R group, as noted above, is substantially or predominantly linear which means there is essentially no branching. As described in detail in U.S. Pat. No. 3,956,401, issued to Michael Scardera and Robert N. Scott on May 11, 1976, the R group is derived from a linear alcohol and generally from a mixture of linear alcohols. Due to the nature of the process by which these alcohols are prepared, there may be small amounts of branched-chains present. The terms "linear" or "substantially linear" radical when used in the specification and claims with respect to R are intended to include such small amounts of branching as defined above. The number of carbon atoms referred to for R is an average number since commercial grade alcohols are generally a mixture of more than one alcohol.

The values of x, y and z integers are average numbers and are based generally on the moles of alkylene oxide used per each mole of alcohol.

The preferred mixture of alcohols to be used to make the aforementioned nonionic surface active agent is comprised of a mixture of linear alcohols having an average of about 8.2 carbon atoms (about 3–30 by weight percent of $C_6$, 30–50 weight percent of $C_8$ and the remainder $C_{10}$) where C is defined throughout the claims and description to mean a linear or substantially linear alcohol and where the subscript following C is the number of carbon atoms in that linear alcohol, produced by Continental Oil Co. of Saddle Brook, New Jersey. Other alcohol mixtures which made surfactants having the above-stated structure can be employed herein, too.

Specific preferred examples of surfactants employed include those represented by the formulae $$RO-(CH_2-\underset{\underset{CH_3}{|}}{CH}-O)_3-(CH_2-CH_2-O)_{12}-(CH_2-\underset{\underset{CH_3}{|}}{CH}-O)_{18}-H$$

$$RO-(CH_2-\underset{\underset{CH_3}{|}}{CH}-O)_3-(CH_2-CH_2-O)_{12}-(CH_2-\underset{\underset{CH_3}{|}}{CH}-O)_{15}-H$$

with R being a substantially linear, alkyl radical having an average of from about 7 to about 10 carbon atoms.

These surfactants are generally made by the sequential, i.e., block, oxyalkylation of alcohols with (1) 3 moles of propylene oxide (PO), (2) 12 moles of ethylene oxide (EO), followed by either 18 or 15 moles of propylene oxide (PO) employing conventional techniques of making these types of adducts.

The second component B of a first dispersion is an alkyl phosphate ester in which the alkyl group contains an average of about 16–28 carbon atoms. Any suitable ester or mixture thereof may be employed as taught in the prior art. It is preferred to employ those alkyl phosphates esters in which the alkyl group contains an average of 18–25 carbon atoms.

The alkyl phosphate ester can be prepared, using conventional methods, by the reaction of a phosphorating agent with one or more alkyl alcohols having the above specified average content of carbon atoms in the alkyl chain. In effecting the reaction, it is preferable to employ such relative proportions of reactants as to provide a molar ratio of alcohols to phosphorating agent, ranging from about 1:1 to about 6:1. Usually, the phosphorating agent is phosphorous pentoxide or a polyphosphoric acid such as 115 percent polyphosphoric acid. A mixture compounds usually results. These compounds, the exact structures of which are not known, may include monomeric, dimeric and polymeric adducts. Reactions of polyphosphoric acid or phosphorous pentoxide and long chain ($C_{10}$ . . . $C_{28}$) alcohols to prepare phosphate ester is well established in the literature. The general methods of preparation of phosphate esters like those of the present invention can be found in *Organic Phosphorus Compounds,* Vol. 6, by Kosolapoff, G. M. and Maier, L., Wiley-Interscience, 1973, especially Chapter 15, and in *Organophosphorus Compounds* by Kosolapoff, G. M., John Wiley & Sons, Inc., 1950, in particular pages 222–277 and 343–345. Both of these references are incorporated into this application for this purpose.

A specific example of alcohol mixtures that can be employed is an alcohol mixture having a homolog distribution of approximately $C_{18}$ and lower (2 weight percent), $C_{20}$ (60 percent), $C_{22}$ (20 percent), $C_{24}$ (10 percent), $C_{26}$ (5 percent) and $C_{28}$ and higher (3 percent). Another example of an alcohol mixture that can be employed is an alcohol mixture having a homolog distribution of approximately $C_{18}$ and lower (1 percent), $C_{20}$ (5 percent), $C_{22}$ (60 percent), $C_{24}$ (21 percent), $C_{26}$ (9 percent) and $C_{28}$ and higher (4 percent). Of the two mixtures, the first is preferred. In both examples, C is as previously defined. Moreover, other alcohol mixtures having formula within the claimed limits and other phosphorating agents which give the desired properties may be employed.

If desired, hydrogen peroxide or other suitable bleaching agents may be combined with the phosphate ester or with the total dispersion in order to bleach or lighten the color of the dispersion thereby making it more attractive. Water may be added to further improve the storage stability of the phosphate ester product and increase the amount of monomeric esters therein.

The dispersion generally contains a weight ratio of the non-ionic surfactant to the phosphate ester from about 1:1 to about 99.9:0.1 preferably above 3:1 to about 90:1, and more preferably about 9:1 to about 49:1.

A second dispersion adapted to be formulated with detergents which may be employed with the process of this invention is disclosed in U.S. Pat. No. 3,741,912, supra, and hereby incorporated by reference in its entirety and comprises two components:

a component A:

about 95.0 to 99.5 weight percent nonionic surface active component, selected from the group consisting of (a) polyoxyethylene condensates of alkyl phenols having from about 6 to 20 carbon atoms in the alkyl portion and the benzyl ethers of said polyoxyethylene condensates of alkyl phenols, (b) cogeneric mixtures of conjugated polyoxyalkylene compounds containing in their structure the residue of an active hydrogen-containing compound having from about 2–6 carbon atoms, at least one hydrophobic chain of units selected from the group consisting of oxypropylene and oxypropylene-oxyethylene units in which the oxygen/carbon atom ratio does not exceed 0.40 and at least one hydrophilic chain of units selected from the group consisting of oxyethylene and oxyethylene-oxypropylene units in which the oxygen/carbon atom ratio is greater than 0.40, (c) polyoxyethylene esters of higher fatty acids having from about 8 to 22 carbon atoms in the acyl group, (d) polyoxyethylene condensates of higher fatty amides having from about 8 to 22 carbon atoms in the fatty acyl group, and (e) alkylene oxide adducts of higher aliphatic compounds selected from the group consisting of alcohols and thioalcohols having from about 8 to 22 carbon atoms in the aliphatic portion;

and a component B:

about 0.5 to 5.0 weight percent of (a) alkyl phosphate ester having about 18 carbon atoms in the alkyl radical.

The preferred alkyl phosphate esters which are used in the compositions of this invention are predominantly monostearyl phosphate which can contain, in addition thereto, di- and tristearyl phosphates and monoleyl phosphates which can contain, in addition thereto, di- and trioleyl phosphates.

The alkyl phosphate esters available on the market are generally mixtures of mono- and dialkyl phosphate esters which may also contain some trialkyl phosphate. For purposes of this invention, the preferred alkyl phosphate ester compositions can contain, in addition to the monoalkyl phosphate, up to about 50 mole percent of the dialkyl phosphate and up to about 5 weight percent of the trialkyl phosphate. In a preferred embodiment of this invention, at least 50 mole percent of the stearyl acid phosphate component is the monostearyl phosphate.

The salts and particularly the alkali metal salts of the alkyl phosphate esters may also be employed as is apparent to anyone skilled in the art. Accordingly, the expressions "stearyl acid phosphate" and "oleyl acid phosphate", as used herein, include the salts of the stearyl and oleyl acid phosphates.

Although not required, an oxyethylated amine may be added to the alkyl phosphate ester of the second embodiment prior to blending. For example, an oxyethylated amine is selected from the group consisting of $$R_1-N\begin{matrix}(CH_2-CH_2O)_nH\\(CH_2-CH_2O)_nH\end{matrix} \quad (1)$$

-continued

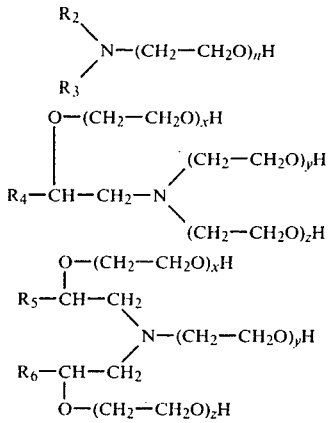

(2)

(3)

(4)

wherein $R_1$, $R_2$, $R_3$, $R_4$, $R_5$ and $R_6$ are each alkyl groups having from about 10 to 20 carbon atoms each and wherein n ranges from 2 to about 5 and (x+y+z) ranges from 1 to about 50, and the weight ratio of said alkyl phosphate ester (a) to said oxyethylated alkyl amine (b) being from about 2:1 to 1:2.

The compositions of the invention generally contain from about 95.0 to 99.5 weight percent of the non-ionic surface active agent and from about 0.5 to 5.0 weight percent total of the alkyl phosphate ester plus the oxyethylated alkyl amine. As previously stated, the ratio of the alkylphosphate ester to the oxyethylated alkyl amine must be from about 2:1 to 1:2. The compositions are readily prepared by blending the ingredients in the aforementioned proportions. The composition may be added to the automatic dishwashing detergent in order to reduce foaming during use thereof.

A particular example of the above described second dispersion is comprised of about 3 percent by weight stearyl acid phosphate dispersed in a linear alcohol containing about 12 to 17 carbon atoms and block oxyalkylated with ethylene oxide and propylene oxide having an average molecular weight of about 900 to 1200, a mole ratio of propylene oxide to ethylene oxide of about 1.2–1.3:1 and a propylene oxide alcohol mole ratio of about 8:1.

The automatic dishwashing detergents to which the compositions of the invention are added in order to reduce the foaming of aqueous solutions thereof in the presence of protein type such as soil generally contain 0 to 95 weight percent of an alkylene condensed phosphate salt such as tetrasodium pyrophosphate and those polyphosphates of the calcium and magnesium ion sequestering type whose $Na_2O/P_2O_5$ ratios range from 1:1 to 1.67:1 and 5 to 100 weight percent of an alkaline detergent salt such as sodium carbonate, sodium bicarbonate and mixtures thereof, di- and trisodium orthophosphate, sodium metasilicate, sodium sesquisilicate, borax and sodium borate. In addition, these detergents often include 5 to 25 weight percent chlorinated trisodium phosphate. A mixture of lithium hypochlorite or chlorinated cyanuric acid and trisodium phosphate can be used in place of chlorinated trisodium phosphate. An automatic dishwashing detergent of this type can be prepared by adding an aqueous silicate solution to substantially anhydrous sodium tripolyphosphate and subsequently adding chlorinated trisodium phosphate thereto under the conditions as described in U.S. Pat. No. 2,895,916, supra.

The automatic dishwasher detergents that can be combined with the present dispersion include a variety of commercially available detergent formulations. These may consist of inorganic salts, such as phosphates and silicates (referred to as "detergent builders"). They may or may not include a chlorinated compound such as potassium dichloroisocyanate or chlorinated trisodium phosphate and the percentages of the other builders may be varied. Thus, it is readily apparent that the dispersion of the invention can be employed in any dishwashing detergent formulation as disclosed or used in the prior art.

The following examples are presented to define the invention more fully without any intention of being limited thereby. All parts and percentages are by weight unless otherwise specified.

EXAMPLE 1

About 2190 pounds of unstable dispersion of an alkyl phosphate ester in a linear alcohol and having a weight ratio of alkyl phosphate ester to linear alcohol of about 1:19 prepared according to the methods taught in U.S. Pat. No. 4,070,298, supra, was added to a 750-gallon stainless steel reactor equipped with an agitation system. The material was heated to about 70° C. to about 77° C. and a full vacuum was applied. The agitator was rotated at about 100 revolutions per minute (rpm) and had a tip speed of about 733 feet per minute. Three portions of the dispersion were separated and cooled under conditions hereafter described. All three portions were cooled from about 77° C. to about 32° C.

The first portion was cooled at a rate of about 22° C. per hour at an agitation rate of 100 rpm and an agitator blade tip speed of about 733 feet per minute. Visual observation of the first portion indicated essentially no settling and hence a stable dispersion for at least 30 days. Thereafter, about 5 percent by volume of the mixture settled (after 53 days).

COMPARATIVE TEST A

The second portion was cooled at a cooling rate of about 8° C. per hour with an agitation rate of about 100 rpm and an agitator blade tip speed of about 733 feet per minute. The second portion remained stable for about 53 days and thereafter about 11 percent by volume settled.

COMPARATIVE TEST B

The third portion was cooled at a rate of about 11° C. per hour but had an agitation rate of about 52 rpm and an agitator blade tip speed of about 381 feet per minute. A visual observation of the material prepared in the third portion indicated that the dispersion was unstable after about one day. After about 53 days about 35 percent by volume had settled.

EXAMPLE 2

Comparative Test A of Example 2 was a preparation of a defoaming detergent additive composition according to methods taught in U.S. Pat. No. 4,070,298, supra.

The detergent additive was prepared by blending together two components described below in a two-part sequence, Part I and Part II.

Part I—Preparation of $C_{20+}$ Phosphate Ester Using Phosphorous Pentoxide

A $C_{20+}$ phosphate ester was prepared from phosphorous pentoxide and a linear alcohol known in the trade as ALFOL 20+ alcohol having a homolog distribution of approximately $C_{18}$ and lower (2 weight percent), $C_{20}$ (60 percent), $C_{22}$ (20 percent), $C_{24}$ (10 percent), $C_{26}$ (5 percent) and $C_{28}$ and higher (3 percent) as follows:

About 23 pounds of the alcohol as described above was added to a 20-gallon 316 stainless steel reactor equipped with an agitator, temperature monitoring system and nitrogen blanket. The alcohol was then heated to about 50° to about 60° C. until the alcohol was molten. About 20 pounds of phosphorous pentoxide ($P_2O_5$) was added to the molten alcohol. A total of about 90 additional pounds of alcohol was added. After about 2.5 hours, the addition of alcohol was complete.

At the end of that time, about 2.4 pounds as 100 percent hydrogen peroxide by weight was added to the mixture. About 11.3 pounds of water was added to the mixture and the mixture was stirred for an additional hour. The reaction product, $C_{20+}$ phosphate ester, was removed from the reactor as a liquid at a temperature of about 82° C.

Part II—Preparation of Phosphate Ester - Non-Ionic Surfactant Composition

About six parts of the $C_{20+}$ phosphate ester and about 94 parts of a low-foaming surfactant of a composition $$RO-(CH_2-\underset{CH_3}{CH}-O)_3-(CH_2-CH_2-O)_{12}-(CH_2-\underset{CH_3}{CH}-O)_{18}-H,$$ where R is a substantially linear, alkyl radical having an average of about 8.2 carbon atoms (about 23 percent of $C_6$, 39 percent of $C_8$ and 38 percent of $C_{10}$), prepared according to the method taught in U.S. Pat. No. 3,956,401, supra, were admixed and thereafter heated to a blend temperature of about 70° C. in a 750-gallon glass-lined steel reactor equipped with an agitator. The mixture was stirred at about 60 rpm or about 500 feet per minute agitator blade tip speed.

The mixture was then cooled very slowly at about 3° C. per hour employing essentially no agitation.

A visual inspection with a microscope and a measurement of the particle size of the particles of phosphate ester dispersed in the alcohol revealed an average particle size of about 0.15 millimeter in diameter.

After about 5 days, a visual inspection of the dispersion revealed that the dispersion had phase separated into two distinct phases and that the dispersion was unstable as prepared in Comparative Test A.

About 3600 pounds of the unstable dispersion prepared as previously described (Comparative Test A of Example 2) was added to a 750-gallon 316 stainless steel reactor equipped with an agitation system and the method of this invention employed to prepare a long term storage stable dispersion.

The unstable dispersion was heated to about 77° C. to about 93° C. The agitator blade revolutions per minute were about 110 and the agitator blade tip speed was about 734 feet per minute. The dispersion was vigorously agitated for about one day.

The reactor heating system was turned off and full cooling was applied to the reactor and its contents as vigorous agitation was continued. The reactor cooling rate was monitored on a strip chart recorder. The reactor contents were cooled from about 77° C. to about 32° C. at a cooling rate above linear with time at a rate of about 30° C. per hour for about 90 minutes.

This procedure resulted in the preparation of a highly storage stable dispersion. Immediately after preparation, a visual inspection indicated the dispersion was stable and had a particle size of about 0.02 millimeter in diameter indicating a significant decrease in particle size from the 0.15 millimeter particle size previously prepared.

The dispersion was removed from the reactor and stored in sealed epoxy-lined 55-gallon drums in a drum field. The drums were subjected to ambient weather temperatures in the range from about −20° to about 120° F. for over about 400 days. A visual physical observation of the drummed material indicated that the dispersion remained very stable even after about 400 days in ambient storage.

EXAMPLE 4

A one-pint sample of a dispersion comprising about 3 percent by weight stearyl acid phosphate dispersed in a linear alcohol containing about 12–17 carbon atoms and block oxyalkylated with ethylene oxide and propylene oxide having an average molecular weight of about 900 to about 1200, a mole ratio of propylene oxide to ethylene oxide of about 1.2–1.3:1, a propylene oxide to alcohol mole ratio of about 8:1, also known in the trade as PLUROFAC® RA-43 surfactant and produced commercially by the BASF Wyandotte Corporation was obtained.

A portion of the dispersion as obtained was added to a laboratory flask and was heated to a temperature to about 70° C. while being vigorously agitated. The sample was held at about 70° C. for about one hour to effect the liquification of the contents. Thereafter, the sample was rapidly cooled by immersing the flask and contents thereof in an ice bath. No agitation was effected during cooling. The sample was cooled at the rate of about 30° C. per hour until the sample temperature was about 0° C.

A visual observation of the material indicated that after about 30 days only about 23 percent by volume of the dispersion had settled.

After 122 days, the percent of the dispersion which settled remained at about 26 percent by volume.

COMPARATIVE TEST A

The quart of dispersion described above as obtained was vigorously shaken and placed on a laboratory shelf for about 48 hours at a temperature of about 25° C. A visual observation indicated that about 80 percent by volume of the material settled.

EXAMPLE 5

In example 5, a long term storage dispersion was prepared in accordance with the process of this invention.

About 610 pounds of a surfactant prepared according to U.S. Pat. No. 3,956,401, supra, and characterized by the formula:

$$RO-(CH_2-\underset{CH}{\underset{|}{CH}}-O)_3-(CH_2-CH_2-O)_{12}-(CH_2-\underset{CH_3}{\underset{|}{CH}}-O)_{18}-H$$

with R being a substantially linear alkyl radical, having an average of about 7 to about 10 carbon atoms and about 70 pounds of a 50:50 weight mixture of a phosphate ester of a linear primary alcohol having about 20 carbon atoms and prepared from phosphorous pentoxide and the surfactant as described above were mixed in a 250-gallon stainless steel reactor equipped with a mechanical agitation system.

The dispersion was heated to about 70° C., until the dispersion was a molten blend. The molten blend was agitated employing a mechanical agitator, having an agitator blade tip speed of about 430 feet per minute. The molten blend was rapidly cooled at a rate of about 11° C. per hour for about 240 minutes to a temperature of about 32° C. and was vigorously agitated as described previously while the rapid cooling was effected. The dispersion was visually observed to be stable immediately after preparation. After about 230 days storage at about 25° C., the dispersion showed essentially no settling, indicating a long term storage stable dispersion.

What is claimed is:

1. In a method for preparing a storage stable dispersion of an alkyl phosphate ester having an average of about 16 to about 28 carbon atoms in the alkyl radical dispersed in a nonionic surface active agent the improvement which comprises:

(a) heating a blend of an alkyl phosphate ester and a nonionic surface active agent to a temperature sufficient to form a molten blend by liquifying said alkyl phosphate ester, said blend being agitated during said heating; and (b) rapidly cooling said molten blend to a temperature below the melting point of said alkyl phosphate ester to form a dispersion, said molten blend being cooled at a rate greater than about 8° C. per hour; and wherein during said rapid cooling said molten blend is vigorously agitated to a physical state in which various portions of said molten blend are in a highly turbulent and violent flux.

2. The process of claim 1, wherein said dispersion is heated to a temperature in the range from about 40° to about 100° C.

3. The process of claim 2, wherein said dispersion is heated to a temperature in the range from about 70° to about 95° C.

4. The process of claim 3, wherein said molten blend is cooled to a temperature in the range from about 0° to about 50° C.

5. The process of claim 4, wherein said molten blend is cooled to a temperature in the range from about 20° to about 40° C.

6. The process of claim 5, wherein an agitator is employed to vigorously agitate said molten blend and whose agitator blade tip speed is in the range from about 400 to about 900 feet per minute.

7. The process of claim 6, wherein the tip speed of said agitator blades is in the range from about 550 to about 750 feet per minute.

8. The process of claim 7, wherein said dispersion is comprised of:

(A) a nonionic surface active agent having the formula $$RO-(CH_2-\underset{\underset{R'}{|}}{CH}-O)_x-(CH_2-CH_2-O)_y-CH_2-\underset{\underset{R''}{|}}{CH}-O)_z-H$$

wherein

R is a substantially linear, alkyl radical having an average from about 6 to about 12 carbon atoms, R′ is a linear, alkyl radical having an average of from 1 to about 4 carbon atoms, R″ is a linear, alkyl radical having an average of from 1 to about 4 carbon atoms, x is an integer from 1 to about 6, y is an integer from about 4 to about 20, and z is an integer from about 4 to about 25, and (B) an alkyl phosphate ester having an average of about 16 to about 28 carbon atoms in the alkyl radical, wherein the weight ratio of (A):(B) is from about 1:1 to about 99.9:0.1.

9. The process of claim 8, wherein each of the radicals R′ and R″ is methyl, and wherein said alkyl phosphate ester is a phosphorous pentoxide ester, wherein the radical R contains an average of about 7–10 carbon atoms, and wherein as applied to said formula, x is an integer of 2–4, y is an integer of 5–15 and z is an integer of 6–20.

10. The process of claim 7 wherein said dispersion is comprised of:

(A) about 95.0 to 99.5 weight percent nonionic surface active component, selected from the group consisting of (a) polyoxyethylene condensates of alkyl phenols having from about 6 to 20 carbon atoms in the alkyl portion and the benzyl ethers of said polyoxyethylene condensates of alkyl phenols, (b) cogeneric mixtures of conjugated polyoxyalkylene compounds containing in their structure the residue of an active hydrogen-containing compound having from about 2–6 carbon atoms, at least one hydrophobic chain of units selected from the group consisting of oxypropylene and oxypropylene-oxyethylene units in which the oxygen/carbon atom ratio does not exceed 0.40 and at least one hydrophilic chain of units selected from the group consisting of oxyethylene and oxyethylene-oxypropylene units in which the oxygen/carbon atom ratio is greater than 0.40, (c) polyoxyethylene esters of higher fatty acids having from about 8 to 22 carbon atoms in the acyl group, (d) polyoxyethylene condensates of higher fatty amides having from about 8 to 22 carbon atoms in the fatty acyl group, and (e) alkylene oxide adducts of higher aliphatic compounds selected from the group consisting of alcohols and thioalcohols having from about 8 to 22 carbon atoms in the aliphatic portion, and (B) about 0.5 to 5.0 weight percent of (a) alkyl phosphate ester having about 18 carbon atoms in the alkyl radical.

11. The process of claim 10 wherein said alkyl phosphate ester is stearyl acid phosphate.

12. The process of claim 11 wherein said alkyl phosphate ester component consists essentially of up to about 50 mole percent dialkyl phosphate, up to about 5 weight percent trialkyl phosphate, with the balance monoalkyl phosphate.

13. The process of claim 8 wherein R is a substantially linear alkyl radical having an average of from about 7 to about 10 carbon atoms.

14. The process of claim 12 wherein R′ is a linear, alkyl radical having an average of from about 1 to about 2 carbon atoms.

15. The process of claim 14 wherein R″ is a linear, alkyl radical having an average of from 1 to about 2 carbon atoms.

* * * * *

UNITED STATES PATENT AND TRADEMARK OFFICE

CERTIFICATE OF CORRECTION

PATENT NO. : 4,263,160

DATED : April 21, 1981

INVENTOR(S) : Suzanne A. Morse

It is certified that error appears in the above—identified patent and that said Letters Patent is hereby corrected as shown below:

Column 2, line 23, "A method of" should read --A method for--.

Column 3, line 47, "feed" should read --feet--.

Column 5, line 8, "phates" should read --phate--.

Column 5, line 20, after "mixture", insert --of--.

Column 5, line 38, "$C_{18}$ and lower" should read --$C_{18}$ and lower--.

Column 5, line 40, "$C_{28}$ and higher" should read --$C_{28}$ and higher--.

Column 5, line 43, "$C_{18}$ and lower" should read --$C_{18}$ and lower--.

Column 5, line 45, "$C_{28}$ and higher" should read --$C_{28}$ and higher--.

Column 9, line 2, "$C_{18}$ and lower" should read --$C_{18}$ and lower--.

Column 9, line 4, "$C_{28}$ and higher" should read --$C_{28}$ and higher--.

UNITED STATES PATENT AND TRADEMARK OFFICE

CERTIFICATE OF CORRECTION

PATENT NO. : 4,263,160

DATED : April 21, 1981

INVENTOR(S) : Suzanne A. Morse

It is certified that error appears in the above—identified patent and that said Letters Patent is hereby corrected as shown below:

Column 9, lines 26-29, " $RO-(CH_2-\underset{CH_3}{CH}-O)_3-(CH_2-CH_2-O)_{12}-(CH_2-\underset{CH_3}{CH}-O)_{18}-H$ "

should read -- $RO-(CH_2-\underset{\underset{CH_3}{|}}{CH}-O)_3-(CH_2-CH_2-O)_{12}-(CH_2-\underset{\underset{CH_3}{|}}{CH}-O)_{18}-H$ --.

Column 10, lines 63-65, " $RO-(CH_2-\underset{\underset{CH}{|}}{CH}-O)_3-(CH_2-CH_2-O)_{12}-(CH_2-\underset{\underset{CH_3}{|}}{CH}-O)_{18}-H$ "

should read -- $RO-(CH_2-\underset{\underset{CH_3}{|}}{CH}-O)_3-(CH_2-CH_2-O)_{12}-(CH_2-\underset{\underset{CH_3}{|}}{CH}-O)_{18}-H$ --.

Column 12, line 65, claim 15, "14" should read --13--.

Signed and Sealed this

***Twenty-second* Day of *June 1982***

[SEAL]

*Attest:*

GERALD J. MOSSINGHOFF

*Attesting Officer* *Commissioner of Patents and Trademarks*